United States Patent [19]

Torii

[11] 4,380,311

[45] Apr. 19, 1983

[54] DEVICE FOR GUIDING A KNITTED OR WOVEN FABRIC

[75] Inventor: Soichi Torii, Kyoto, Japan

[73] Assignee: Torri Winding Machine Co., Ltd., Kyoto, Japan

[21] Appl. No.: 204,375

[22] PCT Filed: Jul. 19, 1979

[86] PCT No.: PCT/JP79/00190

§ 371 Date: Jul. 29, 1980

§ 102(e) Date: Jul. 23, 1980

[87] PCT Pub. No.: WO80/01158

PCT Pub. Date: Jun. 12, 1980

[30] Foreign Application Priority Data

Nov. 29, 1978 [JP] Japan ..... 53-165440

[51] Int. Cl.[3] ..... B65H 17/20

[52] U.S. Cl. ..... 226/190; 242/76

[58] Field of Search ..... 226/190–193, 226/189, 113; 57/34 R, 35; 28/5, 72.3; 242/53, 76

[56] References Cited

U.S. PATENT DOCUMENTS 3,506,419 4/1970 Smith et al. ..... 226/193 X 3,981,129 9/1976 Briaire ..... 57/35

*Primary Examiner*—Leonard D. Christian

*Attorney, Agent, or Firm*—Burgess, Ryan and Wayne

[57] ABSTRACT

A device for guiding a knitted or woven fabric flattened or folded into half-width which prevents creases or wrinkles from occurring in the conveyed fabric. The guiding device comprises a plurality of fabric guiding surfaces wich are rotatable around an axis, which axis is perpendicular to the conveying direction of said fabric; and a plurality of spaces for receiving a part of the fabric, provided between two adjacent fabric guiding surfaces. The fabric guiding surfaces are composed of a plurality of roller-shaped bars. Alternatively, the fabric guiding surfaces are composed of parts of the circumferential surface of a cylindrical roller, each said part extending axially and separated from adjacent parts by grooves, which grooves act as the spaces for receiving a part of the fabric.

9 Claims, 10 Drawing Figures

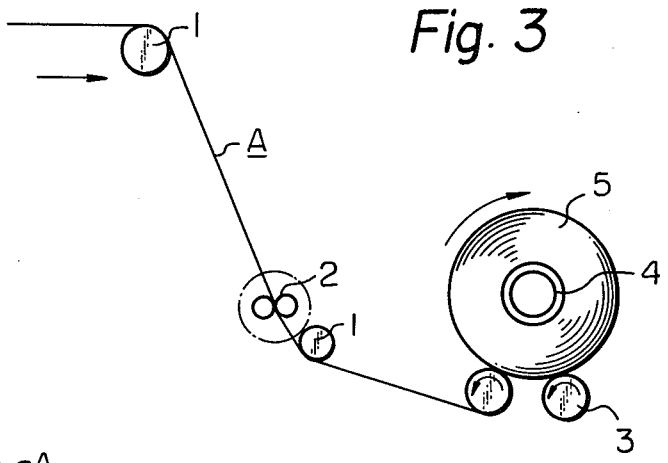
Fig. 3
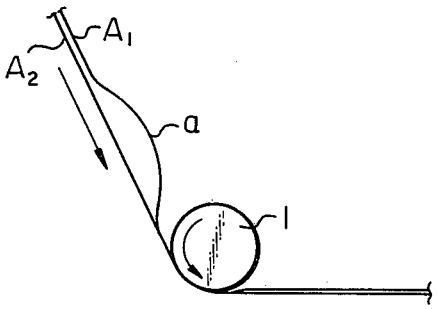
Fig. 4
Fig. 5
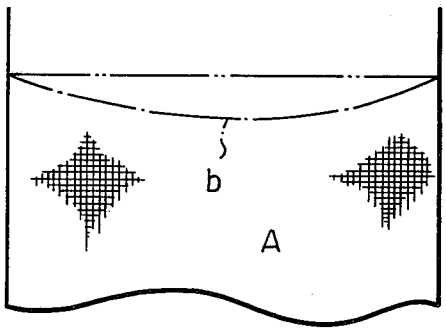

DEVICE FOR GUIDING A KNITTED OR WOVEN FABRIC

TECHNICAL FIELD

The invention relates to a device for guiding a knitted or woven fabric flattened or folded into half-width, such as a collapsed circular knitted fabric, a flattened tubular woven fabric and a fabric folded longitudinally at the center of its width so that one half of the fabric is superposed on the other half of the fabric, in process of producing or finishing the fabric.

BACKGROUND ART

Known in the art is a cylindrical guide roller for guiding a fabric. It is very difficult to maintain an even tension in upper and lower halves of a fabric (hereinafter, each half of a fabric is called a half-fabric) folded or flattened into half-width, such as a flattened circular knitted fabric, a flattened tubular woven fabric and a fabric folded longitudinally at the center of its width, during the running of the flattened or folded fabric which is taken up by a taking-up mechanism, for example, a pair of nip rollers rotating positively, a winding device and the like, in a process for producing the fabric or a finishing process thereof. Usually a guide roller is disposed upstream or downstream of a taking-up mechanism in a path of a running fabric. Slack of a half-fabric to be directly contacted with a guide roller (hereinafter such half-fabric is called an inside half-fabric) appears at a portion just before it contacts the guide roller, which slack extends transversely in the fabric. This is due to an uneveness of tension in the inside half-fabric and the other half-fabric not to be directly contacted with a guide roller (hereinafter such half-fabric is called an outside half-fabric), and due to the difference in length of the inside and outside half-fabrics conveyed along with the guide roller. The reason such difference occurs is that the outside half-fabric is conveyed faster than the inside half-fabric because the diameter of the guide roller acting on the outside half-fabric is substantially increased by the thickness of the inside half-fabric.

However, the slack of the inside half-fabric is allowed only to some degree, because the inside half-fabric and the outside half-fabric are connected to each other at one edge or both edges thereof. As a result, when the slack of the inside half-fabric exceeds a certain degree, the slack portion is caused to overlay itself, which results in creases, wrinkles or folds extenting in the transverse direction of the fabric, and then, the creases, wrinkles or folds pass over the guide roller. After that, the fabric having creases, wrinkles or folds may be wound on a cloth roller.

For example, in a circular loom disclosed in U.S. Pat. No. 3,871,413 and developed by the same inventor as the present invention or other conventional circular loom, a tubular woven fabric is taken up upwards along an axis of a ring-shaped guide rail for guiding shuttles, and is conveyed in the form of being fattened into half-width through guide rollers and pinch rollers to a winding device. In the winding device the flattened tubular woven fabric is wound on a cloth roller disposed on and rotated by frictional contact with a pair of friction rollers which have axes parallel to each other. In this case, pinch rollers are adapted to pinch both edges of a tubular woven fabric flattened into half-width and to stretch the fabric in the width direction, i.e. transverse direction, in order to remove longitudinal creases or wrinkles in the tubular woven fabric. However, when a conventional cylindrical roller with a smooth surface is used as a guide roller, slack ocurs gradually in an inside half-fabric at a position just before the fabric comes into engagement with the guide roller. This is due to the difference in distance from the axis of the guide roller between the inside half-fabric and the outside half-fabric. Such slack tends to increase gradually. When such slack expands to some degree, it cause the fabric to have creases or wrinkles extending transversally, and this creased or winkled fabric is wound on a cloth roll. This is a problem which remains to be solved, not only the above-mentioned circular loom but, also, generally in a manufacturing process or a finishing process for a fabric flattened or folded into half-width.

DISCLOSURE OF INVENTION

An object of the present invention is to provide a device for guiding a knitted or woven fabric flattened or folded into half-width, substantially without creases or wrinkles to a taking-up region, especially to a winding region, in a manufacturing process or a finishing process for the fabric.

In order to attain the above-mentioned object, according to the present invention there is provided a guiding device having a plurality of fabric guiding surfaces spaced the same distance radially from an axis perpendicular to a conveying direction of a knitted or woven fabric folded into half-width, said fabric guiding surfaces being in contact with said fabric and being rotated. A small amount of slack or loop existing in the fabric when the fabric reaches the guiding device, falls into a space between adjacent fabric guiding surfaces, whereby the small amount of the slack is forwarded. Thus, small amounts of the slack are forwarded one after another by successive spaces, so that the slack is prevented from increasing and creases or wrinkles do not occur. As a result, the above-mentioned problem can be solved.

Preferably, a guiding device of the present invention comprises a plurality of roller-shaped bars to provide the fabric guiding surfaces, a shaft extenting perpendicular to the conveying direction of the fabric, and a supporting means for supporting the bars parallel to the shaft, at a certain distance radially from the shaft and with a certain space between adjacent bars. Alternatively, it is also preferable that a guiding device of the present invention comprise a shaft extending perpendicular to the conveying direction of the fabric and a rotatable cylindrical guiding roller which has in its circumferencial surface a plurality of grooves parallel to the shaft, into which grooves a part of the conveyed fabric is able to enter, with the remaining parts of the circumferencial surface serving as a plurality of fabric guiding surfaces.

BRIEF DESCRIPTION OF DRAWINGS

FIG. 3 is a schematic side elevational view of a conventional winding system for a knitted or woven fabric flattened or folded into half-width.

FIG. 4 is an enlarged schematic side view illustrating a part near a guiding roller used in the conventional winding system illustrated in FIG. 3.

FIG. 5 is a schematic plan view illustrating deformation in an inside half-fabric of a fabric, generated while the fabric is guided by a conventional guide roller.

BEST MODE FOR CARRYING OUT THE INVENTION

To facilitate understanding of the present invention, a conventional guide roller used in the above-mentioned prior art and problems in the prior art will be specifically explained with reference to FIGS. 1, 2, 3, 4 and 5.

Figure 1:
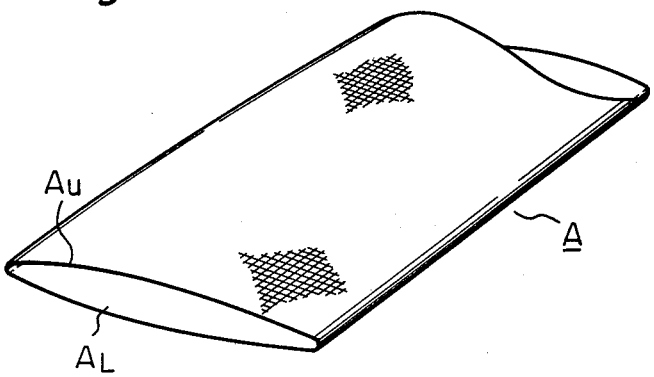
FIG. 1 is a perspective view of a fabric flattened into half-width, which can be guided by a guiding device of the present invention, which fabric is a flattened tubular fabric.

FIG. 1 illustrates a tubular fabric A which is flattened and folded into half-width. At both edges of the flattened fabric an upper half-fabric $A_U$ and a lower half-fabric $A_L$ are connected to each other.

Figure 2:
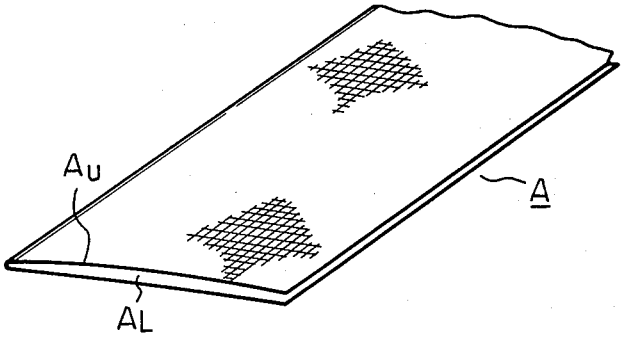
FIG. 2 is a perspective view of a fabric folded into half-width, wherein the fabric is folded longitudinaly at the center of the fabric.

FIG. 2 illustrates a fabric A folded into half-width. In this case, a fabric is folded longitudinally at the center of its width and at only one edge of the folded fabric is the upper half-fabric $A_U$ connected to the lower half-fabric $A_L$.

As illustrated in FIG. 3, in a winding system for a tubular fabric in a cylindrical loom, a tubular fabric A which is flattened and folded into half-width is conveyed through a guide roller 1, pinch roller 2 and another guide roller 1 to a pair of rotating friction rollers 3. Then, the fabric is wound firstly on a cloth roller 4 rotated by contact with the friction rollers 3, and then, it is wound on a roll of wound fabric 5 wound on the cloth roller 4. In this winding system, the guide roller 1 guides a tubrular fabric A and the pinch rollers 2 pinch the fabric A at each edge to tension the fabric in its width direction. Consequently, the pinch rollers 2 have the function of removing longitudinal creases or wrinkles. The friction rollers 3 are driven and take-up the fabric A by driving a surface of a cloth roller 4 or a roll of wound fabric 5.

Because of the fact that a cylindrical roller having a smooth surface is used as a guide roller, as illustrated in FIG. 4, a slack $\alpha$ is liable to occur in an inside half-fabric $A_1$ directly contacting the guide roller 1, in a region just before the tubular fabric contacts the guide roller 1. This tendency is conspicuous in a case where a textile weave of a tubular fabric has a low yarn density, however, in any case it is not possible to avoid the occurance of slack in a fabric. One cause for slack in a folded or flattened fabric is considered to be that, while a fabric A is conveyed along the circumference of the guide roller 1, the amount which is conveyed of an outside half-fabric $A_2$ of the fabric A is much more than that of an inside half-fabric $A_1$, due to difference in distance of the outer and inside half-fabrics from the axis of the guide roller 1.

Such slack $\alpha$, as illustrated in FIG. 4, tends to expand from an edge of the fabric to the center. In FIG. 5, in order to show the slack, a deformed weft yarn is indicated by a broken line b. When slack increases and grows large, the inside half-fabric $A_1$ is folded to the extent corresponding the amount of slack in the half-fabric $A_1$, and then, the inside half-fabric $A_1$ with the formed crease or wrinkle is conveyed while the inside half-fabric $A_1$ is between the surface of the guide roller 1 and the outside half-fabric $A_2$. As a result, creases and wrinkles extending in a widthwise direction appear at places in the inside half-fabric, and then, the fabric A, as it is, is wound into a roll-shaped package.

In a case where, as illustrated in FIG. 3, two guide roller are used, one of which directly contacts one half-fabric of a fabric flattened or folded into half-width, while the other guide roller directly contacts the other half-fabric, the flattened or folded fabric after passing over the two guide rollers may have creases and wrinkles in both half-fabrics. This is because the half-fabric which is an inside half-fabric with regard to the first guide roller, will be an outside half-fabric with regard to the second guide roller, and at the second guide roller the opposite half-fabric is an inside half-fabric.

In order to solve such a problem various studies and experiments were carried out by the present inventor. As a result, the inventor found that, by preventing a slack $\alpha$ of a fabric, which occurs inevitably in an inside half-fabric $A_1$, from increasing with time, the occurance of transverse creases or wrinkles can be prevented. That is, in a case where a fabric flattened into half-width, such as a tubular knitted or woven fabric, is conveyed through a guide member, such as cylindrical guide roller, it is imposible to remove difference in the conveyed amount of each half-fabric between an inside half-fabric $A_1$ and an outside half-fabric $A_2$. However, the inventor of the present invention found that, prevention of generation of slack in an inside half-fabric $A_1$ conveyed to a winding device can be substantially attained by forwarding small amounts of the slack in the inside half fabric $A_1$ one after another.

In accordance with the above-mentioned basic technical idea, some guiding devices were devised and tested. As a result, it was confirmed that each guiding device gives desirable effects.

The present invention will now be described in detail with reference to embodiments illustrated in the accompanying drawings.

Figure 6:
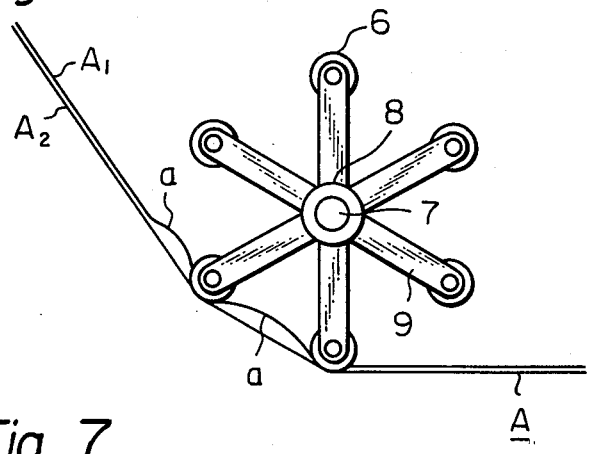
FIG. 6 is a schematic side view of an embodiment of a guiding device according to the present invention.
Figure 7:
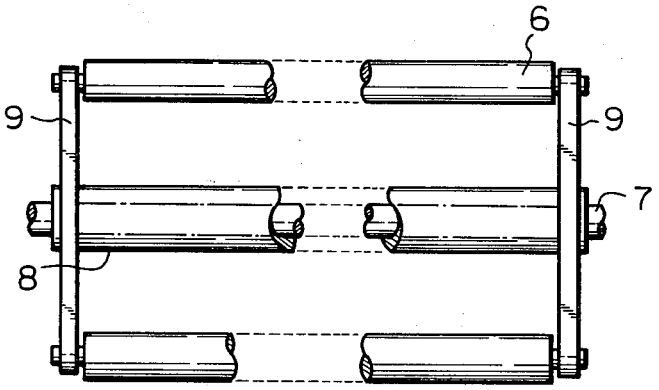
FIG. 7 is a schematic front view, partly omitted, of the guiding device illustrated in FIG. 6.

Referring to FIGS. 6 and 7, in one embodiment of a guiding device of the present invention, the guiding device comprises: a plurality of roller-shaped bars 6 having circular cross-sections; a shaft 7; a tube 8, and; two groups of arms 9 supporting the bars 6. One group of arms is fixed at one end of the tube 8 and the other group of arms is fixed at the opposite end of the tube 8. The shaft 7 is arranged perpendicular to the conveying direction of a fabric flattened or folded into half-width. In this embodiment, the shaft 7 is stationary and the tube 8 is rotatably mounted on the shaft 7 by means of bearings. The bars 6 are non-rotatably supported by the two groups of arms 9, each group being secured to the tube 8 at an end part of the tube. Every arm 9 has the same length and extends radially from the tube 8 at a certain angular distance. Therefore, each bar 6 is arranged parallel to the axis of the shaft 7, with a certain spacing between adjacent bars, and is spaced a certain distance radially from the axis of the shaft 7.

With the above-mentioned embodiment of a guiding device of the present invention, one or two bars 6 are engaged with a flattened or folded fabric at one time, and by the running of the fabric, the bars 6 and the tube 8 are rotated together around the shaft 7. Consequently, the bars 6 come into contact with the fabric one after the other. In this case, slack may be generated in the inside half-fabric $A_1$ due to difference in conveyed amount between the outside half-fabric $A_2$ and inside half-fabric $A_1$. However, since each bar 6 is rotated about the shaft 7 and engages with the fabric A in turn, slack is moved between adjacent bars 6 as soon as the slack is generated and small amounts of the slack are conveyed forward one after another. In other words, a part of the slack is conveyed by each bar 6, and therefore, according to the above-mentioned guiding device slack is not allowed to increase and expand. As a result, with the above-mentioned guiding device, an inside half-fabric $A_1$ is prevented from being folded transversely to create transverse creases or wrinkles.

Figure 8:
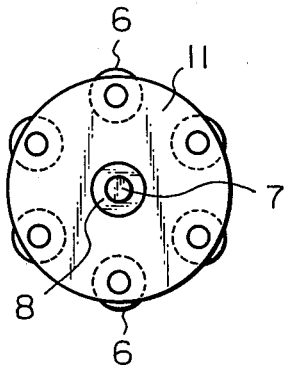
FIG. 8 is a schematic side view of a modified embodiment of the guiding device illustrated in FIG. 6.

Various modifications can be applied to the above-mentioned embodiment. For example, two round discs may be used in place of arms 9. As illustrated in FIG. 8 the disks 11 are disposed at both end parts of the tube 8, respectively, and are concentric with the tube 8. Bars 6 are supported by the disks 11 near the circumference of the disks 11. The bars 6 are parallel to the axis of the shaft 7 or an axis of rotation.

Another modification of the first embodiment is as follows. A shaft 7 is rotatably supported, a tube 8 is fixed to the shaft 7, arms 9 or disks 11 are fixed to the tube 8, and bars 6 are fixed to the arms or disks. Consequently the guiding device of such construction is integrally rotated by the running fabric.

A further modification of the first embodiment is as follows. A shaft 7 is driven by means driving mechanism or a motor. A tube 8 is fixed to the shaft 7 and arms 9 or disks 11 are fixed to the tube 8. Bars 6 are freely, rotatably supported by arms 9 or disks 11. In this case, when the moving speed of bars is equal to the running speed of the fabric, the bars 6 are not rotated and move together with the fabric. However, when the moving speed of the bars is different from the running speed of the fabric, the bars 6 are rotated to compensate for the difference in speed.

Each of the above-mentioned modifications prevent slack from accumulating.

Figure 9:
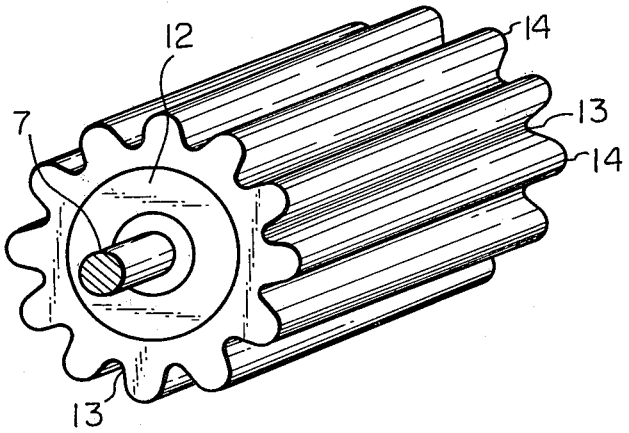
FIG. 9 is a schematic perspective view of another embodiment of the guiding device of the present invention.

As explained before, a function of the guidng device of the present invention is to disperse a slack $\alpha$, which occurs inevitably in an inside half-fabric $A_1$ of a fabric flattened or folded into half-width. From the point of view of the above-mentioned function, another embodiment of a guiding device was invented as illustrated in FIG. 9. According to this embodiment, a guiding roller 12 is mounded on a shaft 7 rotatably disposed. The guiding roller 12 has a plurality of deep grooves 13 parallel to the shaft 7, in its circumferential surface. The grooves 13 provide spaces for receiving a part of the fabric, i.e., slack. The remaing parts of the circumferential surface of the guide roller 12 act as fabric guiding surfaces. That is, the guiding roller 12 has a plurality of fabric guiding surfaces 14 parallel to the axis of rotation and said surfaces are arranged with a certain spacing between adjacent guiding surfaces, and are spaced a certain distance from the rotational axis. It was confirmed by experiments that this embodiment also can achieved the expected results.

Figure 10:
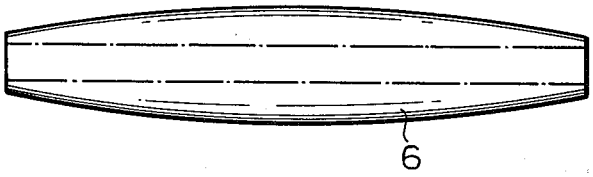
FIG. 10 is a front elevation view of a modified bar used in the guiding device illustrated in FIG. 6, 7 or 8.

A slack $\alpha$ as illustrated in FIG. 4, occurring in an inside half-fabric $A_1$ of a fabric flattened or folded into half-width has a tendency to increase progressively from the edges of the inside half-fabric to the center of the inside half-fabric (see the broken line in FIG. 5). In order to correct the above-mentioned tendency, a barrel-shaped bar as illustrated in FIG. 10 is effectively used in place of a straight cylindrical bar 6 as illustrated in FIG. 7. The barrel-shaped bar has such a shape that the diameter of the bar increases progressively from the end to the middle of the bar.

According to the present invention, a guiding device can disperse slack which is inevitably generated in an inside half-fabric of a fabric folded or flattened into half-width, so that the guiding device can prevent slack from increasing, and thereby, undesirable creases and wrinkles are prevented. Further it should be noted that a guiding device of the present invention has a very simple construction and that its effects are very effective in spite of its simple consturction.

INDUSTRIAL APPLICABILITY

A guiding device of the present invention for guiding a fabric flattened or folded into half-width, such as flattened tubular knitted or woven fabric or a fabric folded longitudinaly at the center of the fabric, is applicable to not only a circular loom and a circular knitting machine but, also, in a process for finishing the fabric.

We claim:

1. A device for guiding a knitted or woven fabric flattened or folded into a half width, to form a fabric having an inside half and an outside half, conveyed by means of a taking-up mechanism which comprises: a plurality of fabric guiding surfaces extending parallel to and arranged equidistant radially around an axis, said axis being perpendicular to the conveying direction of the fabric and parallel to the surface of the flattened or folded fabric, said fabric guiding surfaces being rotatable about said axis, for transverse contact with the inside half of the guided fabric on which inside half is superposed the outside half, and a plurality of spaces for receiving a longitudinal part of the inside half of the fabric, said spaces being formed between adjacent fabric guiding surfaces.

2. A guiding device according to claim 1, wherein the fabric guiding surfaces comprise roller-shaped bars, having a circular cross-section, a supporting means on which said guiding surfaces are mounted, a shaft, on which is mounted said supporting means, whose axis extends perpendicular to the conveying direction of the fabric and parallel to the surfaces of the flattened or folded fabric.

3. A guiding device of claim 2 wherein the supporting means is freely rotatable on the shaft and the bars are secured to the supporting means.

4. A guiding device of claim 2 wherein the shaft is freely rotatable, the supporting means fixedly engages the shaft so as to rotate together with the shaft, and the bars are fixed to the supporting means.

5. A guiding device of claim 2, wherein the shaft is rotatingly driven, the supporting means is fixed to the shaft so as to rotate together with the shaft, and the roller-shaped bars are rotatably supported by the supporting means.

6. A guiding device of claims 2, 3, 4, or 5 wherein the supporting means comprises a tube mounted on the shaft and two groups of a plurality of arms, one group of arms being secured at one end part of the tube and the other group being secured at the opposite end part of the tube, each arm having a free end extending radially outwards from the tube for an equal distance, each arm of one group corresponds to to an arm of the other group, said bars being supported between two arms near the free end thereof.

7. A guiding device of claims 2,3,4, or 5 wherein the supporting means comprises a tube mounted on the shaft, a pair of discs concentrically arranged about the shaft and one secured to the tube at each end thereof, and wherein the bars are supported near the circumference of the discs.

8. A guiding device of claim 2,3,4 or 5 wherein the roller shaped bars have a barrel shape in which the diameter of the bars gradually increases from the ends to the center of the bar.

9. A guiding device of claim 1 which comprises; a shaft which extends perpendicular to the conveying direction of the fabric, and a cylindrical guiding roller, having a circumferential surface, mounted on the shaft, said circumferential surface of said guiding roller comprises a plurality of grooves and raised portions extending parallel to the shaft, said grooves providing the plurality of spaces for receiving a part of the fabric, and the raised portions comprising the fabric guiding surfaces.

* * * * *